United States Patent [19]

Cusick et al.

[11] Patent Number: 4,843,641

[45] **Date of Patent: * Jul. 4, 1989**

[54] RADIATION SHIELD GARMENT

[75] Inventors: Donald J. Cusick, Woodland Hills; Douglas T. Cusick, Saugus, both of Calif.

[73] Assignee: Infab Corporation, Van Nuys, Calif.

[ * ] Notice: The portion of the term of this patent subsequent to Aug. 30, 2005 has been disclaimed.

[21] Appl. No.: 178,384

[22] Filed: Apr. 6, 1988

Related U.S. Application Data

[63] Continuation of Ser. No. 794,567, Nov. 4, 1985, Pat. No. 4,766,608.

[51] Int. Cl.[4] ..... A41D 13/00

[52] U.S. Cl. ..... 2/2; 2/48; 2/76; 2/338

[58] Field of Search ..... 2/2, 2.5, 48, 76, 50, 2/51, 52, 338, DIG. 6

[56] References Cited

U.S. PATENT DOCUMENTS

| | | | |
|---|---|---|---|
| 1,112,248 | 9/1914 | Baldwin | 2/76 |
| 2,404,225 | 7/1946 | Green | 250/516.1 |
| 2,423,002 | 6/1947 | Bray | 2/52 |
| 2,451,282 | 10/1948 | Feibel | 2/52 X |
| 3,052,799 | 9/1962 | Hollands | 250/516.1 |
| 3,086,529 | 4/1963 | Munz et al. | 2/338 X |
| 3,093,829 | 6/1963 | Maine | 250/516.1 X |
| 3,376,865 | 4/1968 | Gamper | 128/579 R |
| 3,452,362 | 7/1969 | Korolick et al. | 2/2.5 |
| 3,557,384 | 1/1971 | Barron et al. | 2/2.5 |
| 3,783,449 | 1/1974 | Davis | 2/2.5 |
| 3,996,620 | 12/1976 | Maine | 2/2 |
| 4,183,097 | 1/1980 | Mellian | 2/2.5 |
| 4,196,355 | 4/1980 | Maine | 250/516.1 |
| 4,417,146 | 11/1983 | Herbert | 250/516.1 |
| 4,441,025 | 4/1984 | McCoy | 2/2.5 X |
| 4,524,463 | 6/1985 | Ogden | 2/76 X |
| 4,602,386 | 7/1986 | Hoffman et al. | 2/2 X |
| 4,627,109 | 12/1986 | Carabelli et al. | 2/44 |

FOREIGN PATENT DOCUMENTS

| | | | |
|---|---|---|---|
| 1492553 | 11/1977 | United Kingdom | 2/DIG. 7 |
| 1603655 | 11/1981 | United Kingdom | 250/516.1 |
| 2152379 | 8/1985 | United Kingdom | 128/518 R |

OTHER PUBLICATIONS

Burlington Medical Supplies Publication pp. 1–20; 3 Mechanic St., Box 215, Merrimac, Mass. 01860.

*Primary Examiner*—Werner H. Schroeder
*Assistant Examiner*—D. Biefeld
*Attorney, Agent, or Firm*—Ladas & Parry

[57] ABSTRACT

A garment for use in a radioactive environment comprises a front portion, a rear portion, a shoulder portion used for suspending the garment over the body of a wearer, and an elasticized belt fixed to the garment at substantially waist or hip level. The belt is adapted to be stretched, tightened and secured around the waist or hips such that at least a part of the weight of the garment is substantially transferred to the waist or hips. The front portion of the garment has a lower flap adapted to lie against the front of the wearer and an upper flap for folding over the lower flap. The elasticized belt is secured releasably to the upper flap of the rear portion. Securing means are provided for holding the belt in the stretched and tightened position, and this securing means comprises at least one Velcro strip attached to the outside surface (when worn) of the belt at the point where the belt is secured to the upper flap, and one or more corresponding Velcro strips secured to the inside surface of the belt at the free end thereof. The strips at each end are adapted to overlie each other when the belt is in the stretched and tightened position around the waist or hips of the wearer.

32 Claims, 8 Drawing Sheets

RADIATION SHIELD GARMENT

This is a continuation of co-pending application Ser. No. 794,567, filed 11/4/85, U.S. Pat. No. 4,766,608, issued 8/30/88.

BACKGROUND OF THE INVENTION

It is necessary for personnel working in or near radioactive environments to wear protective clothing to provide a shield against radioactive rays. For example, hospital personnel employed in the X-ray or radiology units may be exposed to radioactive energy which, as is well known, can be damaging to one's health, particularly over a long period of time.

It is therefore usual that such personnel wear protective shielding when working in such an environment. The garments normally worn comprise an inner and outer lining, with an intermediate layer or layers of lead sheet material embedded within a vinyl matrix. One significant disadvantage of such a garment is that, due to the amount of lead therein, it is extremely heavy and rapidly fatigues the wearer due to its excessive weight. Prior art garments are worn so that the entire weight thereof is carried over the shoulders and upper back of the wearer by means of shoulder straps. An example of such a prior art garment is shown in U.S. Pat. No. 4,441,025 (McCoy). A further example of the prior art is the Mavig apron manufactured by Burkhart/Roentgen.

It is known that a weight carried by the back and shoulder causes significantly greater fatigue than a substantially similar weight carried by the hips. Thus, backpacks for hikers are constructed such that a pack is carried on a frame, while the weight of the frame is strapped around the waist or hips. Another part of the pack is attached to the back mainly for the purpose of stabilizing the backpack and holding it in the vertical position. See, for example, U.S. Pat. No. 4,013,201, Potter.

It is an object of the invention to provide a garment, the weight whereof is distributed to another part of the body better able to withstand such weight. The present invention thus provides an improved garment for use by personnel working in radioactive environments, whereby the weight of the garment is shifted from the shoulders and upper back so as to be carried by the waist of the wearer.

SUMMARY OF THE INVENTION

According to one aspect of the invention there is provided a garment for use in a radioactive environment, the garment comprising: a front portion; a shoulder strap for suspending the garment on the body of a wearer thereof; and an elasticized belt arranged to be fastened around the garment at substantially waist level, the belt being adapted for stretching, tightening and securing around the waist such that at least a part of the weight of the garment is substantially transferred to the waist.

Preferably, the garment further comprises a rear portion and the front portion has a lower flap adapted to lie against the front of the wearer and an upper flap for folding over the lower flap. Conveniently, one end of the elasticized belt is secured to the upper flap of the front portion, the belt having an inside surface which will abut against the front and rear portions of the garment when in the closed position, and an outside surface. The belt may comprise securing means for holding the belt in the stretched and tightened position, and the securing means preferably comprises at least one Velcro strip attached to the outside surface of the belt at that point where the belt is secured to the upper flap, and one or more corresponding Velcro strips secured to the inside surface of the belt near the free end thereof, the strips at one end being adapted to overlie the strips at the other end when the belt is in position around the waist of the wearer.

In another embodiment, the belt may be fixed to the front portion along one side thereof, the free end of the belt being adapted to fasten to the front portion at the other side edge.

The belt is preferably releasably fixed to the garment.

According to another aspect of the invention, there is provided a method of supporting on a wearer a garment for use in a radioactive environment such that the weight of the garment is carried substantially by the waist of the wearer, the method comprising: suspending a garment having a front portion and shoulder straps over the shoulders of the wearer; providing an elasticized belt at the waist level of the garment; and tightening and securing the belt such that the portions of the garment below the belt and at least a part of the garment above the belt are supported on the waist due to the action of the belt in holding the garment firmly against the body.

According to yet another aspect of the invention, there is provided a belt for use with a garment suitable for protection against radiation, the belt comprising: a first end arranged to lie against the garment at substantially hip/waist level; a second end adapted to be secured to the belt when worn by a wearer; securing means for securing the second end to the belt, wherein the belt is comprised of an elasticized material and is adapted for stretching, tightening and securing around at least a part of the waist such that at least a part of the weight of the garment is substantially transferred to be carried by the hips and/or waist. Preferably, the first end of the belt is releasably fixed to the garment. The securing means may comprise a Velcro strip near the first end of the belt, and a corresponding Velcro strip near the second end, the two strips overlying and securing to each other when the garment is worn.

DETAILED DESCRIPTION OF PREFERRED EMBODIMENTS

Figure 1:
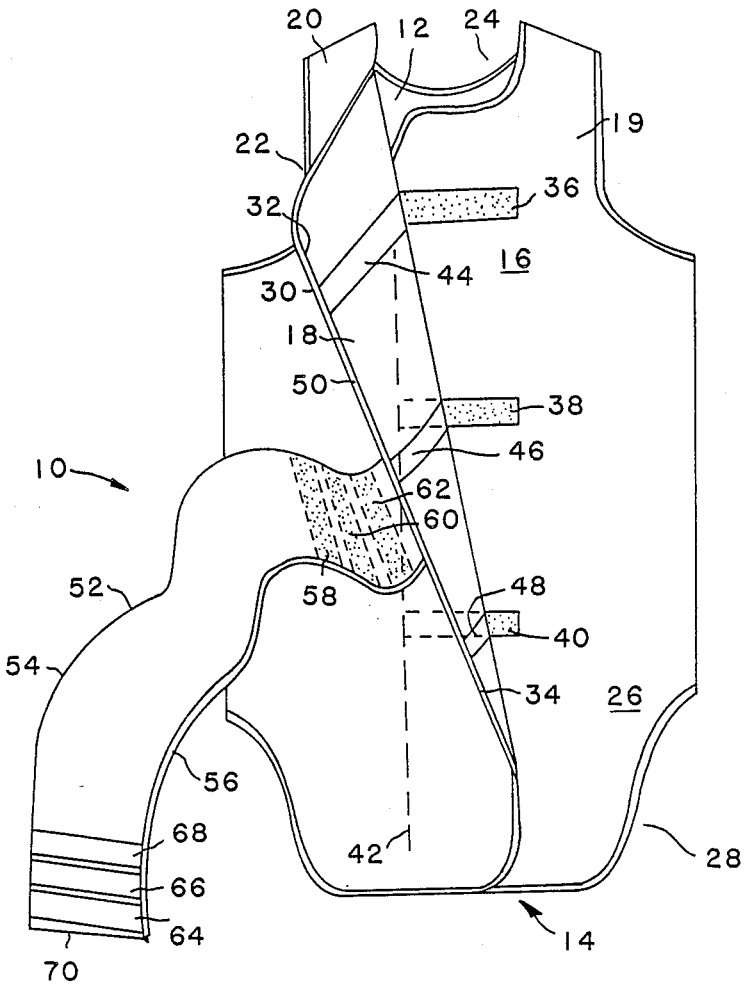
FIG. 1 is a front view of first embodiment of a shield garment of the invention shown in one position.
Figure 2:
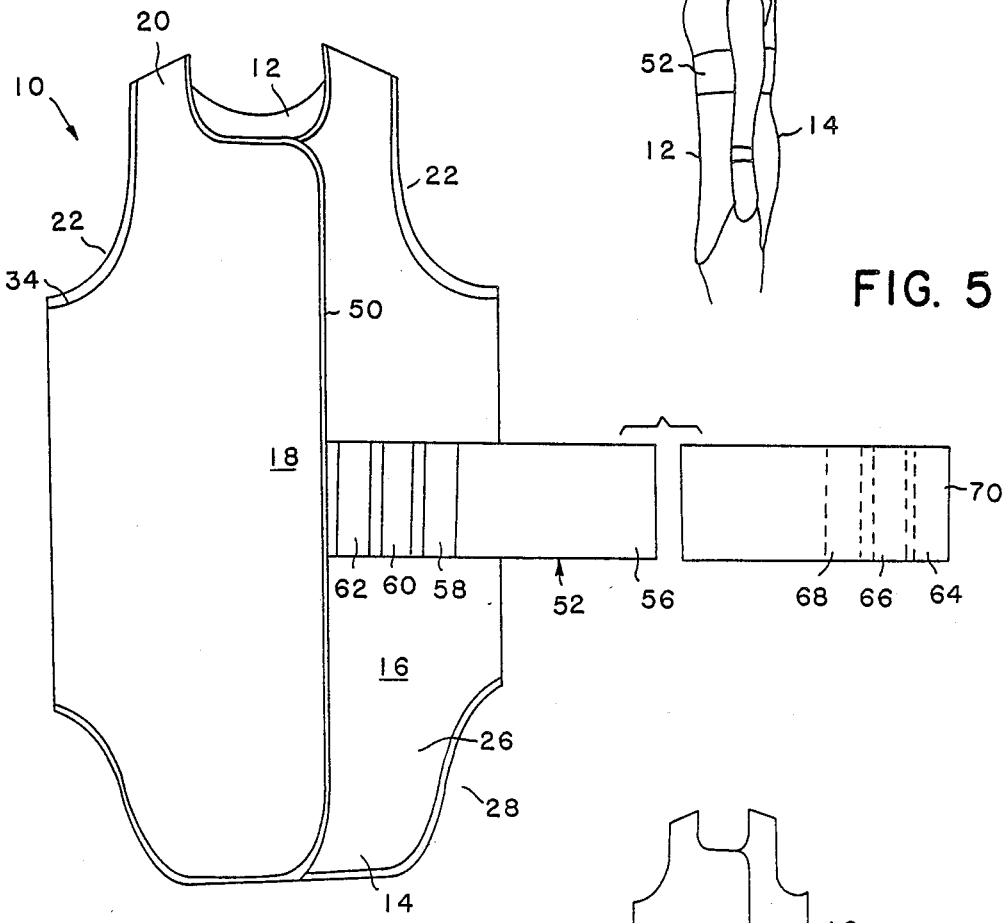
FIG. 2 is a front view of the garment shown in FIG. 1 in a different position.
Figure 5:
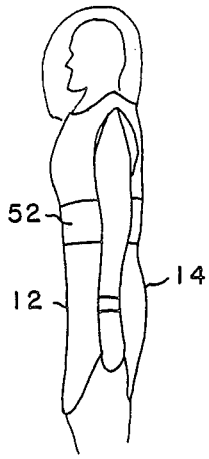
FIG. 5 is a side view of a person wearing the garment shown in FIG. 1.
Figure 3:
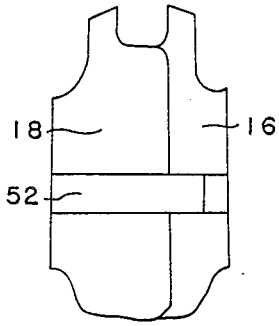
FIG. 3 is a front view of the garment shown in FIG. 1 with the belt in the closed position.
Figure 4A:
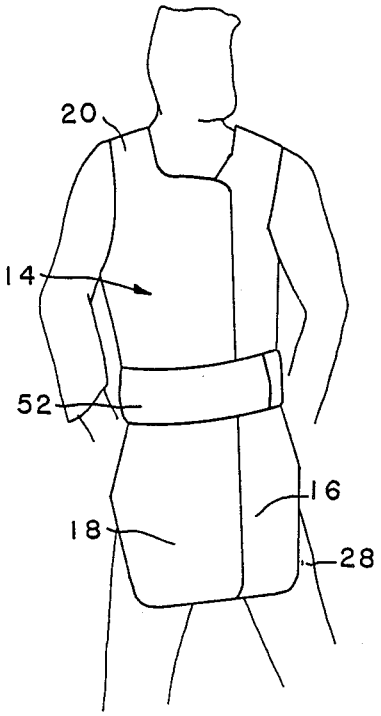
FIG. 4A is a front view of a person wearing the garment shown in FIG. 1.
Figure 4B:
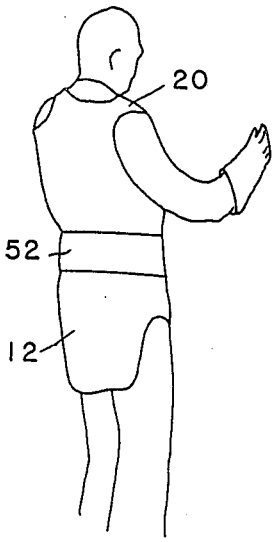
FIG 4B is a rear view of a person wearing the garment shown in FIG. 1.

With reference to the drawings, and particularly FIGS. 1 to 5, there is shown a radiation shield garment 10. The garment 10 comprises a rear portion 12, and a front portion 14 having a lower flap 16 and an upper flap 18. The upper part 19 of the garment 10 has a pair of shoulder straps 20, arm holes 22 and a neck opening 24. The lower portion 26 has a pair of cutaway portions 28 so as not to overly restrict the movement of the wearer.

The garment further comprises an outer lining 30 and an inner lining 32 which are stitched together at the edges of the garment with binding 34. Sheets of lead material encapsulated in a vinyl matrix (not shown), as are well known in the art, are sandwiched between the inner lining 32 and outer lining 30, and provide protection to the wearer of the garment 10 against radiation. The garment 10 is thus for use by personnel working in or near radioactive environments, for example, in hospital radiology sections.

Three sets of Velcro strips 36, 38 and 40 are fixed to the outer surface of the lower flap 16. These strips 36, 38 and 40 are adjacent the edge 42 of the lower flap 16 and extend horizontally therefrom. Complementary Velcro strips 44, 46 and 48 are attached to the inside surface of the upper flap 18, near the edge 50 thereof. The strips 44, 46 and 48 are located so as to substantially overlie the strips 36, 38 and 40 respectively when the garment is being worn. In this way, the lower and upper flaps 16 and 18 will be held together to prevent the garment 10 from slipping off the wearer. Moreover, since the strips extend horizontally, a single garment is suitable for wear by persons of different size and/or girth.

A broad elastic belt 52 is stitched to the upper flap 18 near its edge 50, and at approximately waist level of the garment 10. The belt 52 has an inside surface 54 and an outside surface 56, when worn. Three Velcro strips 58, 60 and 62 are fastened to the outside surface 56 of the belt 52. The strips 58, 60 and 62 form broad bands across the width of the belt 52 near the edge 50 of the upper flap 18. Complementary Velcro strips 64, 66 and 68 are attached to the inside surface 54 of the belt 52 near the free end 70 thereof. The strips 64, 66 and 68 also form broad bands across the width of the belt 52 and are of substantially the same size and shape as the strips 58, 60 and 62.

In use, the wearer dons the garment 10 such that the shoulder straps 20 rest over the shoulders, and the neck is located in the neck opening 24. The arms are accommodated in arm holes 22 and the lower flap 16 is pressed against the front of the body and the upper flap 18 folded thereover. With the upper and lower flaps 18 and 16 properly aligned, the strips 44, 46 and 48 will overlie and fasten to the strips 36, 38 and 40 respectively. It will be appreciated that persons of different size can wear a single size garment since the strips are of elongate shape and can be laterally displaced, yet still fasten to each other.

With the garment 10 secured to the wearer in this fashion, the full weight thereof will be borne through the shoulder straps 20 by the wearer's shoulders and upper back. Since the sheets of lead material within the inner and outer lining 32 and 30 are of relatively substantial weight, this may cause rapid fatigue to the wearer.

This problem is largely overcome by drawing the elasticized belt 52 around the waist with the inside surface 54 thereof against the outer surface of the garment 10. The belt 52 is wrapped fairly tightly around the waist so that the strips 64, 66 and 68 attach to the strips 58, 60 and 62. Which of the strips 64, 66 and 68 (if any) attach to strips 58, 60 and 62 will depend upon the wearer's girth and can be adjusted according to the individual's preference.

The effect of the tightened elastic belt 52 around the waist is to relieve the shoulders of carrying all, or a large portion, of the weight of the garment 10. The belt 52 firmly holds the garment against the waist of the person wearing the garment 10, and the weight of the garment is largely borne from this point. Since the sheets of lead are less bendable than other materials, the belt 52 will also have the effect of carrying the weight of the garment above the level of the belt. In this way, the shoulders will be relieved of supporting a substantial portion of the garment's weight. Since the belt is elasticized, it will yield to the wearer's various movements, at the same time continuing to hold the garment against the body at waist level. The garment thus permits a wide flexibliity of movement without sacrificing any of its functional features.

Figure 6:
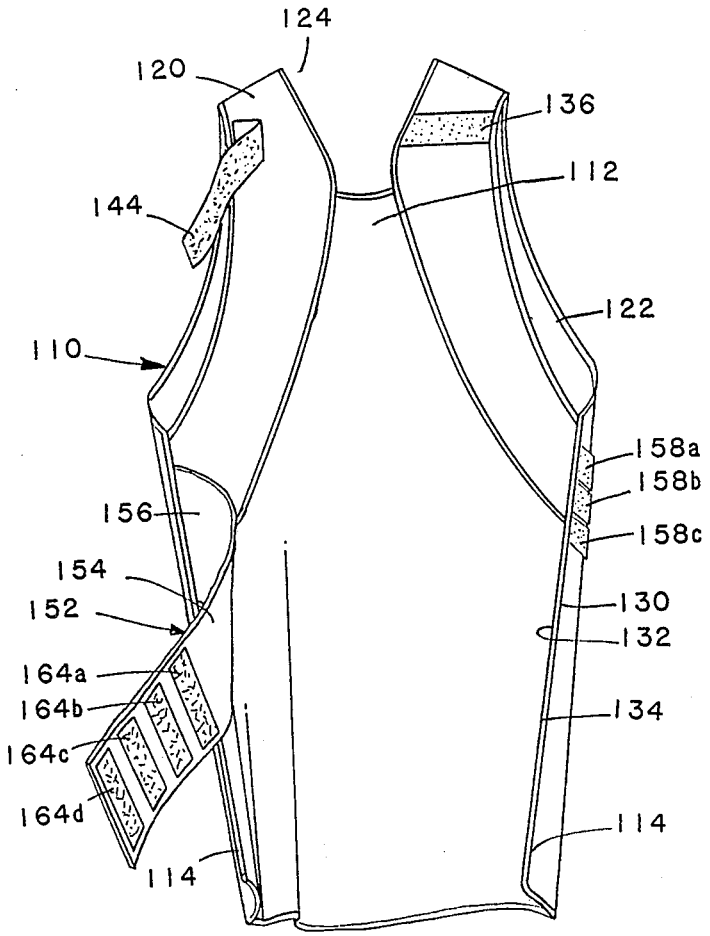
FIG. 6 is a rear view of a second embodiment of a garment of the invention.
Figure 7:
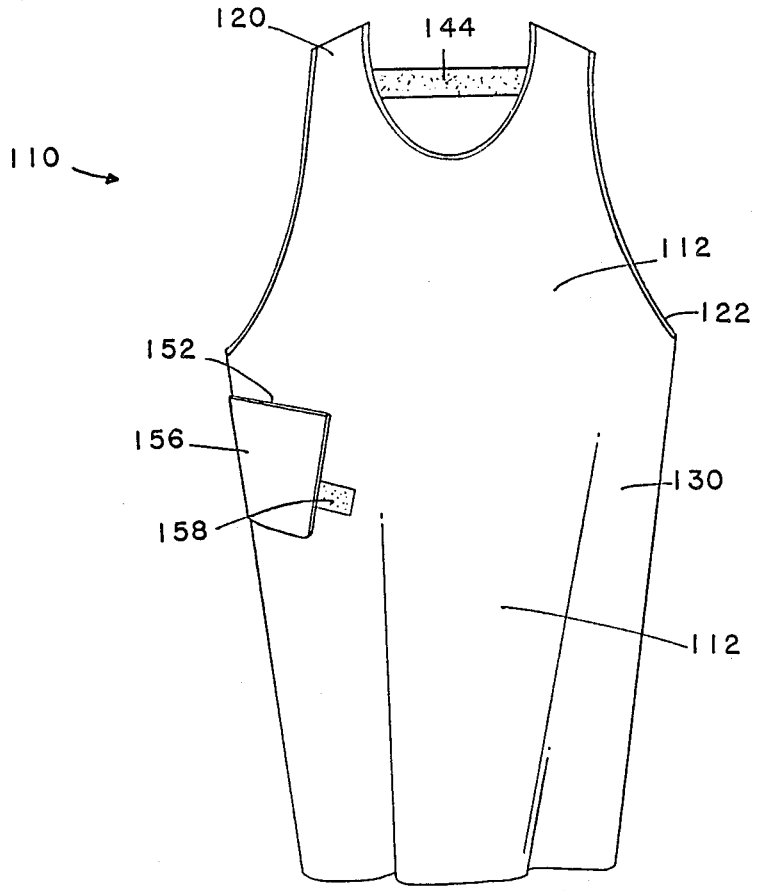
FIG. 7 is a front view of the garment shown in FIG. 6, with the garment in the closed position.
Figure 8:
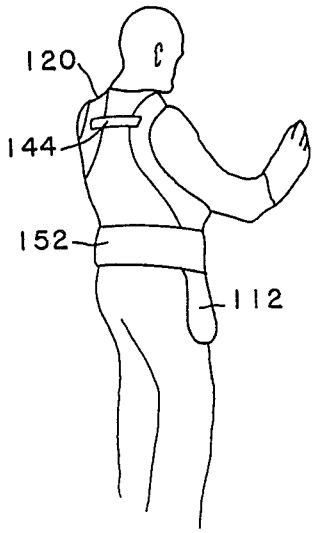
FIG. 8 is a perspective view of the person wearing the garment shown in FIG. 6.

Reference is now made to FIGS. 6, 7 and 8 which show a second embodiment of the invention. In this embodiment, there is shown a garment 110 having a front portion 112 and a pair of shoulder straps 120 defining arm holes 122. A neck opening 124 is defined by the shoulder straps 120 and front portion 112. The garment 110 has a rear portion 114, best shown in FIG. 6.

It will be noted that the garment 110 shown in FIGS. 6, 7 and 8 differs from that shown in FIG. 1 in that it is more in the form of an apron and has a substantially reduced rear portion 114. The garment 110 nevertheless also comprises an outer lining 130, an inner lining 132 stitched together at their edges with binding 134. Sheets of lead material (not shown) are sandwiched between the outer and inner linings 130 and 132, as described with reference to FIGS. 1 to 5 above.

A Velcro strip 136 is fixed to one shoulder strap 120, while a complementary Velcro strip 144 is partially fixed to the other shoulder strap 120. The loose portion of the strip 144 hangs freely and is adapted to overlie and attach to the strip 136 when the garment 110 is worn.

A broad elastic belt 152 is attached to the inner surface of the rear portion 114, at approximately waist level. The belt 152 has an inside surface 154 and an outside surface 156. Four Velcro strips 164*a*, 164*b*, 164*c* and 164*d* are fixed to the inside surface of the belt 152. These strips form four broad bands across the width of the belt 152. Three complementary Velcro strips are obliquely attached to the outer surface of the opposite rear portion 114.

In use, a wearer dons the garment 110 with the shoulder straps 120 over the shoulder and the neck is accommodated in the neck opening 124. The loose portion of strip 144 is pressed against strip 136 to hold the shoulder straps 120 in position. The garment 110 is further fastened by stretching the belt 152 and placing the strips 164 over the strips 158. Considerable leeway is permitted so that a single garment 110 can be worn by persons of varying girth.

With the belt 152 fastened in a relatively tight position, the weight of the garment 110 is shifted from the wearer's shoulders to his/her waist, in substantially the same manner and with the same advantages as described with respect to the first embodiment shown in FIGS. 1 to 5 of the drawings. In this way, the fatigue in wearing a heavy garment is considerably reduced.

Figure 9:
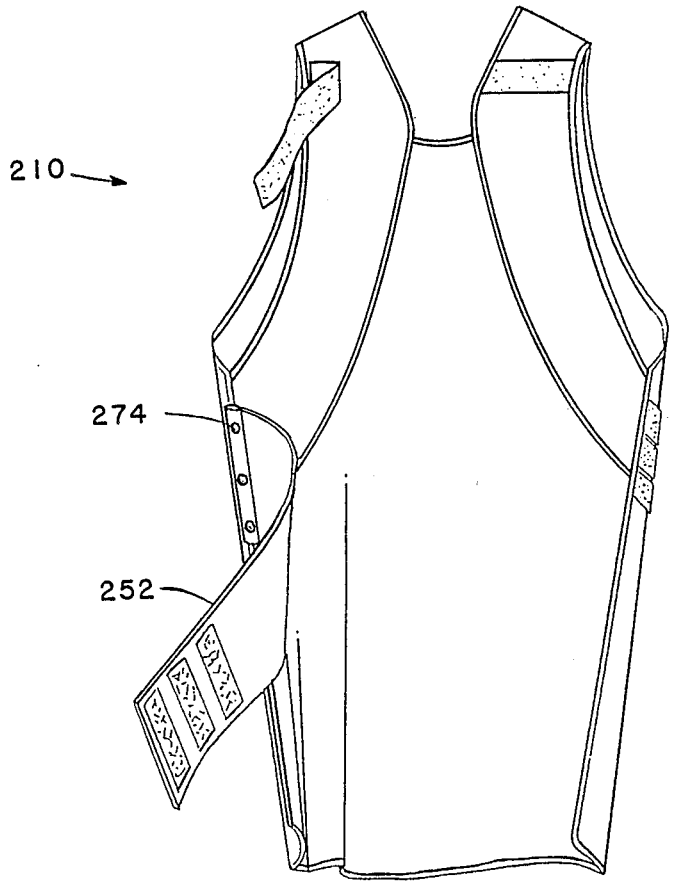
FIG. 9 is a rear view of a third embodiment of a shield garment of the invention showing the feature of the detachable belt.
Figure 10:
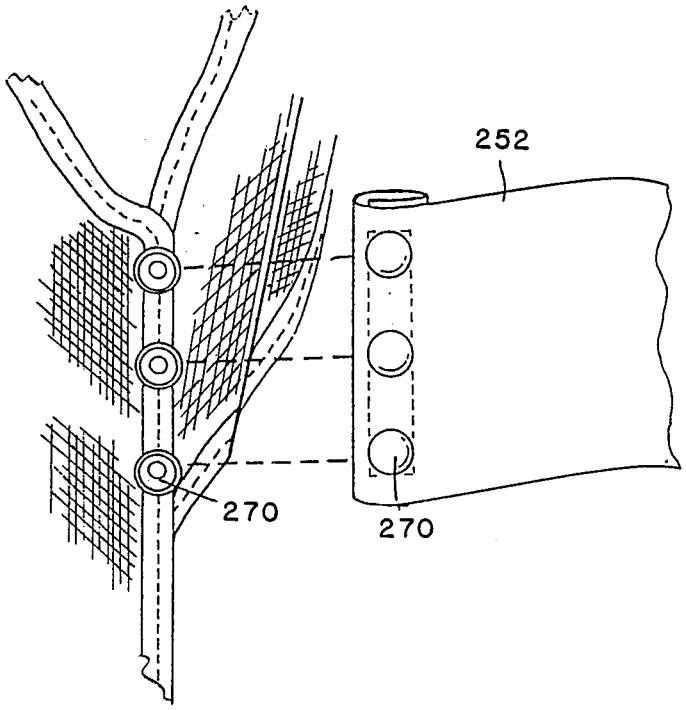
FIG. 10 is a detailed and exploded view of a part of the garment shown in FIG. 9.

With reference to FIGS. 9 and 10 of the drawings there is shown a garment 210, in most respects identical with garment 10 illustrated in FIGS. 6–8. The belt 252 of the garment 210 is releasably fixed to the garment 210 by three pairs of snap buttons 274. In this way, the belt 252 can be easily removed and/or replaced when worn or broken without affecting the remainder of the garment 210.

Although FIGS. 9 and 10 show the garment belt attached to the garment by snap buttons, any suitable manner of attaching the belt may be used. For example, the belt can be fixed to the garment by Velcro, rivets, stitching etc. The belt may also be supported in one or more loops at the waist area of the garment. Indeed, the belt need not be attached to the garment at all, but only fixed to itself when worn around the waist of the garment.

In view of the above description, it will be appreciated that the present invention provides an improved garment for use by a person working in or near a radioactive environment, wherein the weight of the garment is shifted substantially from the shoulders to the waist. It is well known that weights carried by the back and shoulders cause far more fatigue and strain to the wearer than a substantially similar weight which is supported by the waist and/or hips. The tightened elasticized belt of the present invention has exactly this effect, namely, to relieve the shoulders of the weight of this garment and transfer it to the waist. Moreover, the belt yields and permits flexibility of movement without sacrificing its functional features, namely, to hold the garment firmly against the waist of the wearer.

The invention is not limited to the precise constructional details described above. Garments of widely differing shape and size may incorporate the features of the invention for the purpose of shifting the weight of the garment from the shoulder and back to the waist and hips.

We claim:

1. A radiation shield garment comprising:

a flexible front portion;

a shoulder portion connected to the front portion for suspending the garment on the body of a wearer thereof;

an elongated belt arranged to be fastened to completely surround the garment at substantially hip/waist level, the belt being broad and elasticized in at least that portion which, in use, faces the back of the wearer thereof, the belt being adapted for stretching, tightening and securing around at least a part of the waist particularly the back of the wearer of the garment such that at least part of the weight of the garment is substantially transferred to be carried by the hips and/or waist of the wearer.

2. A garment as claimed in claim 1 further comprising a rear portion.

3. A garment as claimed in claim 2 wherein the flexible front portion is comprised of two vertically disposed parts, the first part defining along one side a lower flap adapted to lie against the front of the body of the wearer, the second part defining along one side and upper flap for folding over the lower flap.

4. A garment as claimed in claim 3 further comprising fastening means for securing the upper flap to the lower flap.

5. A garment as claimed in claim 4 wherein the fastening means comprises at least one Velcro strip on the lower flap, and a corresponding Velcro strip on the upper flap, the Velcro strips substantially overlying each other when the garment is on the wearer.

6. A garment as claimed in claim 2 wherein the front portion, rear portion and shoulder portion define a neck opening and a pair of arm holes for the wearer.

7. A garment as claimed in claim 3 wherein one end of the belt is secured to the upper flap of the front portion while the other end thereof is free, the belt having an inside surface which abuts against the front and rear portions of the garment when worn, and an outside surface.

8. A garment as claimed in claim 7 wherein the belt comprises securing means for maintaining the belt in the stretched and tightened position.

9. A garment as claimed in claim 8 wherein the securing means comprises at least one Velcro strip attached to the outside surface of the belt at or near its end where the belt is secured to the upper flap, and at least one corresponding Velcro strip secured to the inside surface of the belt near the free end thereof, the strips at each end being adapted to overlie each other when the belt is tightened into position around the entire waist of the wearer.

10. A garment as claimed in claim 2 further comprising a cutaway portion of the front and rear portions to facilitate freedom of movement of the wearer.

11. A garment as claimed in claim 1 comprising an outer lining, an inner lining, the outer and inner linings being secured together at their edges by binding, and one or more sheets of lead material sandwiched between the inner and outer linings.

12. A garment as claimed in claimed claim 1 further comprising fastening means between the shoulder straps, the fastening means ensuring that the shoulder straps remain over and do not slide from the shoulders of the wearer.

13. A garment as claimed in claim 12 wherein the fastening means comprises a Velcro strip on one of the shoulder straps, and a corresponding Velcro strip partially fixed to the other shoulder strap, the partially fixed strip being arranged to extend across the back of the wearer to lie over the strip.

14. A garment as claimed in claim 1 wherein the belt is fixed to the front portion at or near one side edge thereof, the free end of the belt being adapted to be secured to the front portion at or near the other side edge.

15. A garment as claimed in claim 14 wherein the belt comprises securing means for securing the free end of the belt, the securing means comprising one or more Velcro strips near the free end of the belt and corresponding Velcro strips on the front portion of the garment on the side opposite that to which the belt is fixed.

16. A garment as claimed in claim 1 wherein substantially the entire weight of the garment is carried at the waist or hips of the wearer due to the action of the belt, and only a small portion of the weight of the garment will be supported by the shoulders and upper back of the wearer.

17. A garment as claimed in claim 1 wherein the belt is fixed to the garment.

18. A garment as claimed in claim 1 wherein the belt is releasably fixed to the garment.

19. A garment as claimed in claim 18 wherein the belt is releasably fixed to the garment by fixing means, the fixing means comprising a plurality of snap buttons.

20. A garment as claimed in claim 17 wherein the belt is fixed to the garment by fixing means, the fixing means comprising a plurality of rivets.

21. A garment as claimed in claim 17 wherein the belt is fixed to the garment by fixing means, the fixing means comprising stitching.

22. A method of supporting on a wearer a garment for use in a radioactive environment such that the weight of the garment is carried substantially by the waist or hips of the wearer, the method comprising:

suspending a garment having a front portion and a shoulder portion over the shoulders of the wearer;

providing a belt at the waist or hip level of the garment which belt is broadened and elasticized in at least that portion which faces the lumbar area of the wearer; and tightening and securing the belt such that the portions of the garment below the belt and at least a part of the garment above the belt is supported on the waist or hips due to the action of the belt in holding the garment firmly against the body such that the belt provides lumbar support to the wearer.

23. A method as claimed in claim 22 wherein the belt extends around the full girth of the wearer and is secured to itself.

24. A method as claimed in claim 22 wherein substantially all of the garment above the belt is supported on the waist.

25. A belt for use with a garment suitable for protection against radiation, the belt comprising:

a first end arranged to lie against the garment at substantially hip/waist level;

a second end adapted to be secured to the belt when worn by a wearer;

securing means for securing the second end to the belt, wherein the belt is relatively broad and elasticized in at least that portion thereof which, in use, faces at least the lumbar portion of a wearer of said garment, said belt being adapted for stretching, tightening and securing around at least a part of the waist such that at least a part of the weight of the garment is substantially transferred to be carried by the hips and/or waist of the wearer.

26. A belt as claimed in claim 25 wherein the first end of the belt is fixed to the garment.

27. A belt as claimed in claim 25 wherein the first end of the belt is releasably fixed to the garment.

28. A belt as claimed in claim 25 wherein the securing means comprises a Velcro strip near the first end of the belt, and a corresponding Velcro strip near the second end, the two strips overlying and securing to each other when the garment is worn.

29. A garment as claimed in claim 1, wherein said front portion extends in length from the shoulder area to below the hip area of a wearer.

30. A radiation shield garment comprising:

a front portion; and a shoulder portion connected to the front portion for suspending the garment on the body of a wearer thereof;

a belt which is relatively broad and elasticized in at least that portion thereof which, in use, faces the back of the wearer and which is arranged to be fastened to the garment at a substantially hip/waist level, the belt being adapted for stretching, tightening, and securing around at least a part of the waist, such that at least a part of the weight of the garment is substantially transferred to be carried by the hips and/or waist.

31. The radiation shield garment of claim 25 wherein said broad belt extends entirely around the garment.

32. The radiation shield garment of claim 30 wherein said broad belt extends entirely around the garment.

* * * * *